US008047197B1

(12) United States Patent
Zernich

(10) Patent No.: US 8,047,197 B1
(45) Date of Patent: Nov. 1, 2011

(54) HEAT DEFLECTING SYSTEM

(76) Inventor: Gary M. Zernich, Las Vegas, NV (US)

( * ) Notice: Subject to any disclaimer, the term of this patent is extended or adjusted under 35 U.S.C. 154(b) by 251 days.

(21) Appl. No.: 12/466,506

(22) Filed: May 15, 2009

(51) Int. Cl.
*F24C 3/04* (2006.01)

(52) U.S. Cl. ..... 126/92 B; 126/92 AC; 126/83

(58) Field of Classification Search ..... 126/92 B, 126/92 AC, 92 R, 91 R; 16/267
See application file for complete search history.

(56) References Cited

U.S. PATENT DOCUMENTS

| | | | |
|---|---|---|---|
| 5,964,233 | A | 10/1999 | Clark et al. |
| D445,889 | S | 7/2001 | Resmo et al. |
| D451,988 | S | 12/2001 | Ashton et al. |
| 6,336,450 | B1 | 1/2002 | Collet |
| 6,668,818 | B2 | 12/2003 | Bossler |
| 6,745,759 | B2 | 6/2004 | Bossler |
| 7,278,418 | B2 | 10/2007 | Duphily et al. |
| 2007/0101983 | A1 | 5/2007 | Yao |

FOREIGN PATENT DOCUMENTS

| | | | |
|---|---|---|---|
| WO | WO2007016928 | * | 2/2007 |

* cited by examiner

*Primary Examiner* — Alfred Basichas

(57) ABSTRACT

A heat deflecting system includes a heater with a pole, a heat emitting member attached to an apex of the pole and a cover that is attached to the heat emitting member. The cover has a circular perimeter edge that extends outwardly from the heat emitting member. A plate has a first side, a second side, an upper edge, a lower edge, a first lateral edge and a second lateral edge. The first side of the plate is concavely arcuate from the first lateral edge to the second lateral edge. A plurality of couplers is mounted on the plate and releasably couples the plate to the perimeter edge.

12 Claims, 4 Drawing Sheets

HEAT DEFLECTING SYSTEM

BACKGROUND OF THE DISCLOSURE

Field of the Disclosure

The disclosure relates to heat deflecting devices and more particularly pertains to a new heat deflecting device for directing a greater amount heat where needed.

SUMMARY OF THE DISCLOSURE

An embodiment of the disclosure meets the needs presented above by generally comprising a heater that includes a pole, a heat emitting member attached to an apex of the pole and a cover that is attached to the heat emitting member. The cover has a circular perimeter edge that extends outwardly from the heat emitting member. A plate has a first side, a second side, an upper edge, a lower edge, a first lateral edge and a second lateral edge. The first side of the plate is concavely arcuate from the first lateral edge to the second lateral edge. A plurality of couplers is mounted on the plate and releasably couples the plate to the perimeter edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
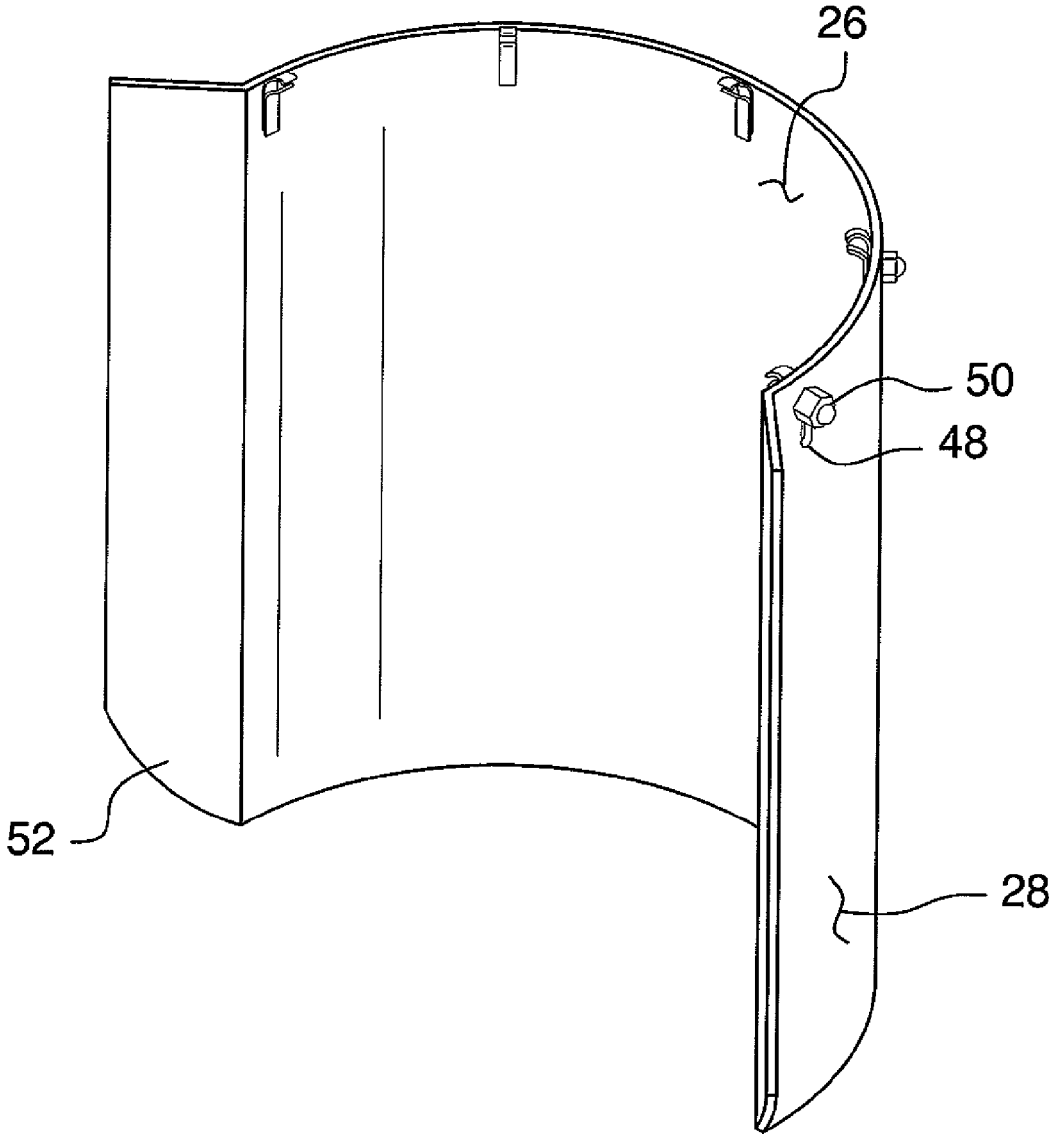
FIG. 1 is a front perspective view of a plate of a heat deflecting system according to an embodiment of the disclosure.
Figure 2:
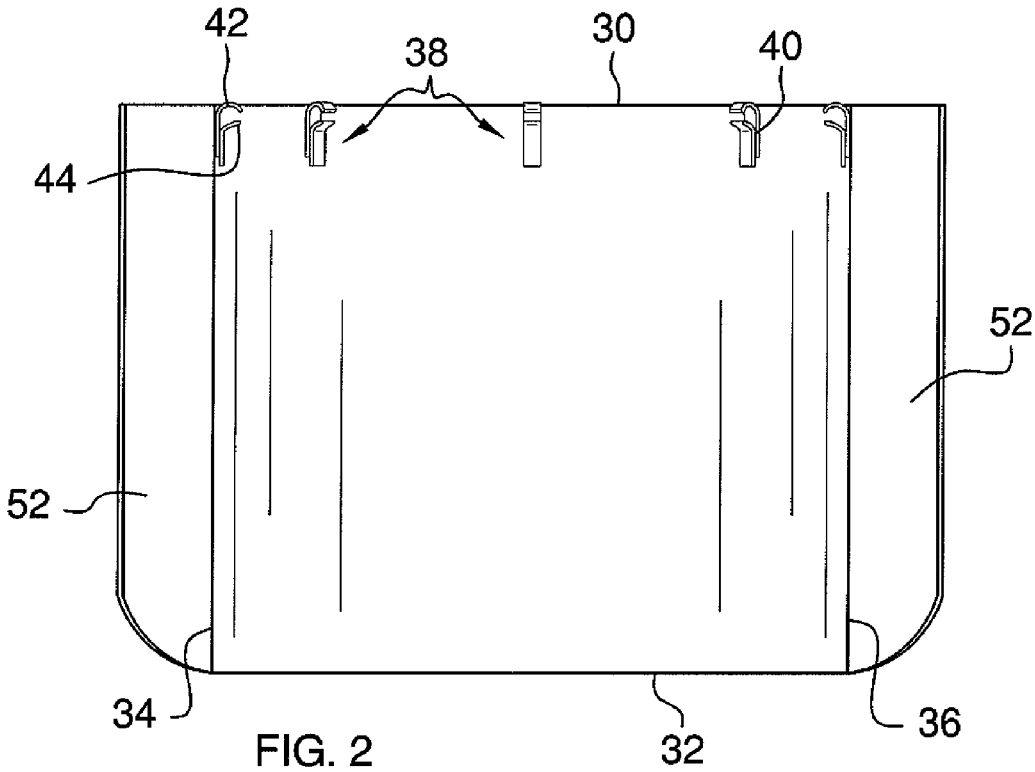
FIG. 2 is a front view of an embodiment of the disclosure.
Figure 3:
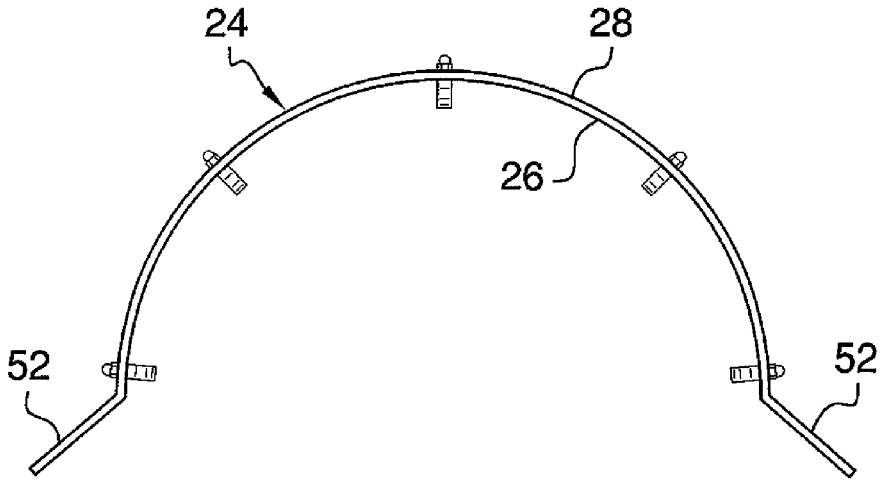
FIG. 3 is a top view of an embodiment of the disclosure.
Figure 4:
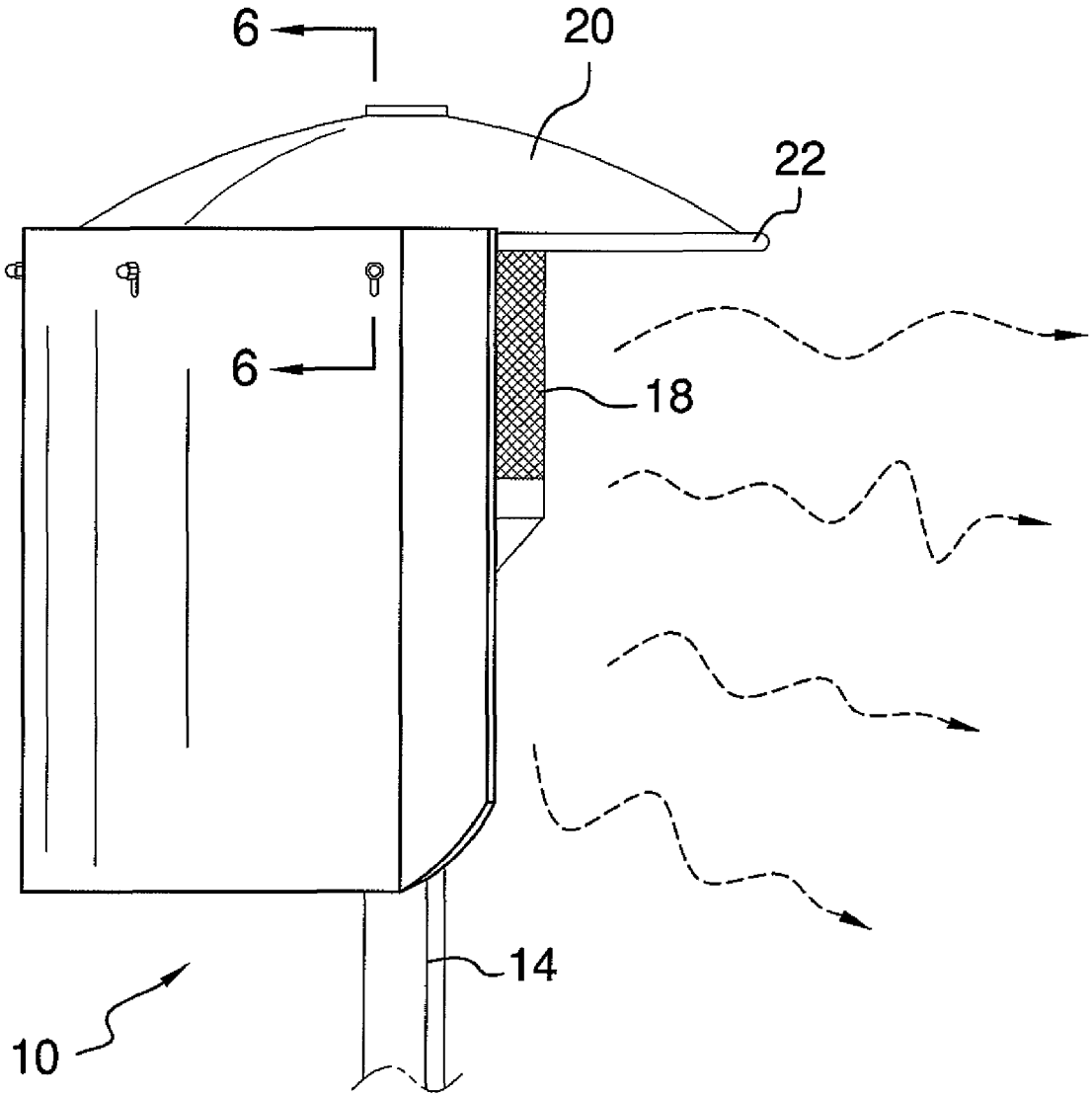
FIG. 4 is a side view of an embodiment of the disclosure.
Figure 6:
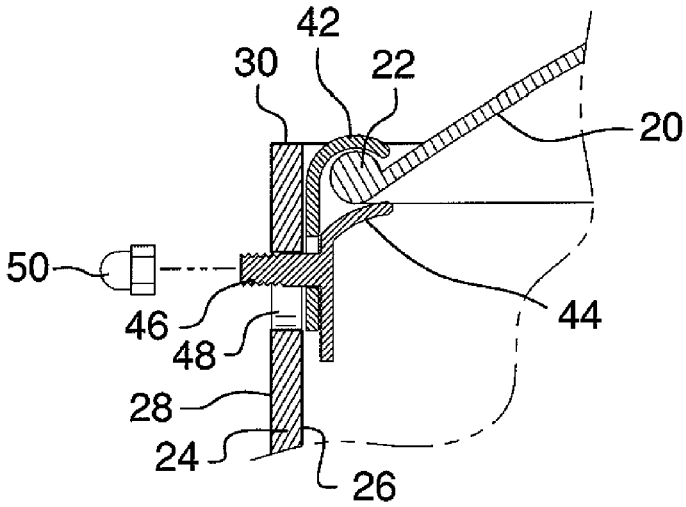
FIG. 6 is a cross-sectional view taken along line 6-6 of FIG. 4 of an embodiment of the disclosure.
Figure 5:
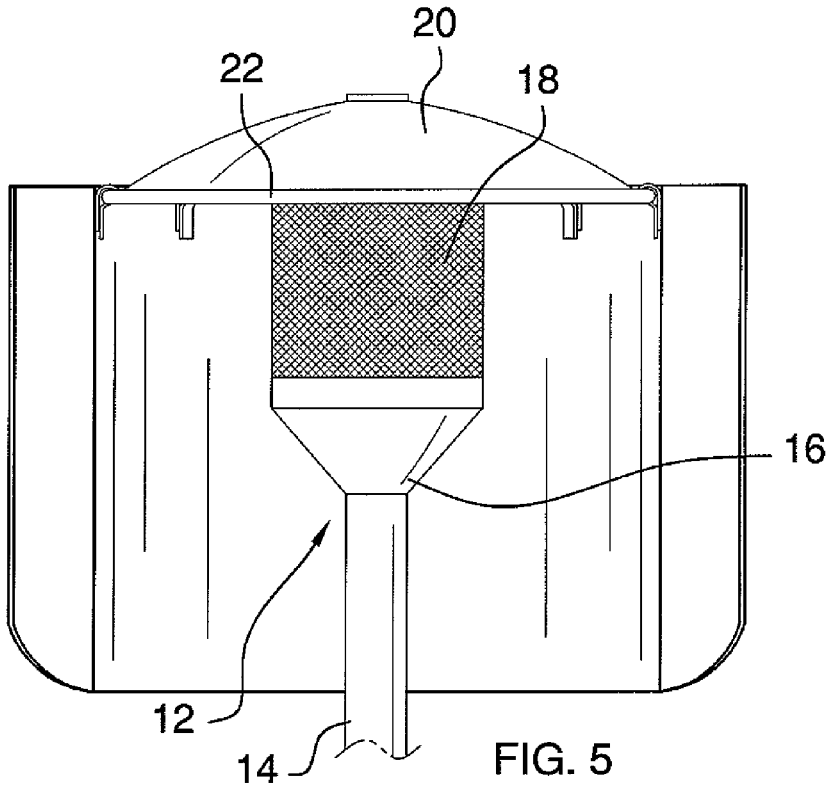
FIG. 5 is a front view of an embodiment of the disclosure.

With reference now to the drawings, and in particular to FIGS. 1 through 6 thereof, a new heat deflecting device embodying the principles and concepts of an embodiment of the disclosure and generally designated by the reference numeral 10 will be described.

As best illustrated in FIGS. 1 through 6, the heat deflecting system 10 generally comprises a heater 12 that includes a pole 14, a heat emitting member 16 attached to an apex 18 of the pole 14 and a cover 20 that is attached to the heat emitting member 16 and which acts as a heat shield for directing heat downward. The heater 12 is a conventional heating assembly typically used outdoors to heat a localized area by burning propane or other fuels. The cover 20 has a circular perimeter edge 22 extending outwardly from the heat emitting member 16.

A plate 24 has a first side 26, a second side 28, an upper edge 30, a lower edge 32, a first lateral edge 34 and a second lateral edge 26. The first side 26 of the plate 24 is concavely arcuate from the first lateral edge 34 to the second lateral edge 36. The plate 24 has a height from the upper edge 30 to the lower edge 32 between 12 inches and 30 inches.

A plurality of couplers 38 is mounted on the plate 24 and releasably couples the plate 24 to the perimeter edge 22. The couplers 38 are each positioned adjacent to the upper edge 30. Each of the couplers 38 includes a clamp 40 having a first arm 42 and a second arm 44 spaced from each other. The perimeter edge 22 is positioned between the first 42 and second 44 arms to secure the plate 24 to the perimeter edge 22. A distance between the first 42 and second 44 arms is selectively adjustable to accommodate different sized perimeter edges 22. A post 46 is attached to the clamp 40 and extends through one of a plurality of apertures 48 in the plate 24. A fastener 50 engages the post 46 with the plate 24 between the clamp 40 and the fastener 50 to retain the clamp 40 on the plate 24. Each of the apertures 48 is vertically elongated to allow vertical adjustment of the clamp 40 with respect to the plate 24.

A pair of panels 52 is provided. Each of the first 34 and second 36 lateral edges has one of the panels 52 attached thereto. The panels 52 may be integrally coupled to the plate 24 and the plate 24 and panels 52 each comprising a metallic material. The panels 52 are angled away from the first side 26 and form an angle with the second side 28 between 90 degrees and 160 degrees.

In use, the plate 24 is attached to the perimeter edge 22 of the cover 20 to help direct heat from the heat emitter 18 toward a particular direction. This will better provide heat where needed and make the heater more efficient.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A heat deflecting system comprising:

a heater including a pole, a heat emitting member attached to an apex of said pole and a cover being attached to said heat emitting member, said cover having a circular perimeter edge extending outwardly from said heat emitting member;

a plate having a first side, a second side, an upper edge, a lower edge, a first lateral edge and a second lateral edge, said first side of said plate being concavely arcuate from said first lateral edge to said second lateral edge;

a plurality of couplers being mounted on said plate and releasably coupling said plate to said perimeter edge, each of said couplers being positioned adjacent to said upper edge, each of said couplers including:

a clamp including a first arm and a second arm spaced from each other, said perimeter edge being positioned between said first and second arms to secure said plate to said perimeter edge; and a post being attached to said clamp and extending through one of a plurality of apertures in said plate, a fastener engaging said post with said plate between said clamp and said fastener to retain said clamp on said plate.

2. The system according to claim 1, wherein said plate has a height from said upper edge to said lower edge between 12 inches and 30 inches.

3. The system according to claim 1, wherein said clamps are vertically adjustable with respect to said upper edge.

4. The system according to claim 1, wherein a distance between said first and second arms of each of said couplers is selectively adjustable.

5. The system according to claim 1, wherein each of said apertures is vertically elongated to allow vertical adjustment of said clamp with respect to said plate.

6. The system according to claim 1, further including a pair of panels, each of said first and second lateral edges having one of said panels attached thereto, said panels being angled away from said first side and forming an angle with said second side between 90 degrees and 160 degrees.

7. A heat deflecting apparatus, said apparatus being mountable on a perimeter edge of a cover mounted on a heater, said apparatus comprising:

a plate having a first side, a second side, an upper edge, a lower edge, a first lateral edge and a second lateral edge, said first side of said plate being concavely arcuate from said first lateral edge to said second lateral edge; and a plurality of couplers being mounted on said plate and being couplable to the perimeter edge to couple said plate to the heater, said couplers being positioned adjacent to said upper edge, each of said couplers including:

a clamp including a first arm and a second arm spaced from each other, the perimeter edge being positionable between said first and second arms to secure said plate to said perimeter edge; and a post being attached to said clamp and extending through one of a plurality of apertures in said plate, a fastener engaging said post with said plate between said clamp and said fastener to retain said clamp on said plate.

8. The apparatus according to claim 7, wherein said plate has a height from said upper edge to said lower edge between 12 inches and 30 inches.

9. The system according to claim 7, wherein a distance between said first and second arms of each of said couplers is selectively adjustable.

10. The system according to claim 7, wherein each of said apertures is vertically elongated to allow vertical adjustment of said clamp with respect to said plate.

11. The system according to claim 7, further including a pair of panels, each of said first and second lateral edges having one of said panels attached thereto, said panels being angled away from said first side and forming an angle with said second side between 90 degrees and 160 degrees.

12. A heat deflecting system comprising:

a heater including a pole, a heat emitting member attached to an apex of said pole and a cover being attached to said heat emitting member, said cover having a circular perimeter edge extending outwardly from said heat emitting member;

a plate having a first side, a second side, an upper edge, a lower edge, a first lateral edge and a second lateral edge, said first side of said plate being concavely arcuate from said first lateral edge to said second lateral edge, said plate having a height from said upper edge to said lower edge between 12 inches and 30 inches;

a plurality of couplers being mounted on said plate and releasably coupling said plate to said perimeter edge, said couplers each being positioned adjacent to said upper edge, each of said couplers including;

a clamp including a first arm and a second arm spaced from each other, said perimeter edge being positioned between said first and second arms to secure said plate to said perimeter edge, a distance between said first and second arms being selectively adjustable;

a post being attached to said clamp and extending through one of a plurality of apertures in said plate, a fastener engaging said post with said plate between said clamp and said fastener to retain said clamp on said plate, each of said apertures being vertically elongated to allow vertical adjustment of said clamp with respect to said plate; and a pair of panels, each of said first and second lateral edges having one of said panels attached thereto, said panels being angled away from said first side and forming an angle with said second side between 90 degrees and 160 degrees.

* * * * *